US010408211B2

(12) United States Patent
Yuan

(10) Patent No.: US 10,408,211 B2
(45) Date of Patent: Sep. 10, 2019

(54) HYDRAULIC SYSTEM FOR PRESSURIZATION OF GAS WITH REDUCTION OF DEAD VOLUME

(71) Applicant: Eaton Intelligent Power Limited, Dublin (IE)

(72) Inventor: QingHui Yuan, Maple Grove, MN (US)

(73) Assignee: Eaton Intelligent Power Limited, Dublin (IE)

( * ) Notice: Subject to any disclaimer, the term of this patent is extended or adjusted under 35 U.S.C. 154(b) by 569 days.

(21) Appl. No.: 14/904,598

(22) PCT Filed: Jul. 14, 2014

(86) PCT No.: PCT/US2014/046495
§ 371 (c)(1),
(2) Date: Jan. 12, 2016

(87) PCT Pub. No.: WO2015/006761
PCT Pub. Date: Jan. 15, 2015

(65) Prior Publication Data

US 2016/0153447 A1 Jun. 2, 2016

Related U.S. Application Data

(60) Provisional application No. 61/845,726, filed on Jul. 12, 2013.

(51) Int. Cl.

| | |
|---|---|
| ***F17C 5/00*** | (2006.01) |
| ***F04B 53/14*** | (2006.01) |
| ***F17C 5/06*** | (2006.01) |

(52) U.S. Cl.
CPC ..... *F04B 53/141* (2013.01); *F17C 5/007* (2013.01); *F17C 5/06* (2013.01);
(Continued)

(58) Field of Classification Search
CPC ..... F04B 53/141; F04B 27/005; F04B 37/00; F04B 39/0011; F17C 5/007; F17C 5/06;
(Continued)

(56) References Cited

U.S. PATENT DOCUMENTS 1,011,226 A 12/1911 Miller
1,044,583 A 11/1912 Selakosky
(Continued)

FOREIGN PATENT DOCUMENTS

DE 10 2008 042 828 A1 4/2010
DE 10 2008 060 598 A1 6/2010
(Continued)

OTHER PUBLICATIONS

International Search Report for corresponding International Patent Application No. PCT/US2014/046495 dated Nov. 26, 2014.
(Continued)

*Primary Examiner* — Essama Omgba
*Assistant Examiner* — Stephen A Mick
(74) *Attorney, Agent, or Firm* — Merchant & Gould P.C.

(57) ABSTRACT

A hydraulic system is provided to reduce a dead volume when pressurizing gas. The system includes a gas source, a gas output, a pressure vessel coupled to the gas source and the gas output, a hydraulic system that forces hydraulic fluid into the pressure vessel from the gas source to compress gas, and an overflow tank that receives overflow of hydraulic fluid once all gas has been expelled from the pressure vessel via the gas output.

20 Claims, 7 Drawing Sheets

(52) U.S. Cl.
CPC ..... *F17C 2205/0335* (2013.01); *F17C 2221/033* (2013.01); *F17C 2223/0123* (2013.01); *F17C 2223/033* (2013.01); *F17C 2225/0123* (2013.01); *F17C 2225/036* (2013.01); *F17C 2227/0192* (2013.01); *F17C 2227/041* (2013.01); *F17C 2227/046* (2013.01); *F17C 2265/065* (2013.01); *F17C 2270/0139* (2013.01)

(58) Field of Classification Search
CPC ..... F17C 2227/0192; F17C 2265/065; F17C 2223/033; F17C 2227/046; F17C 2227/041; F17C 2225/0123; F17C 2221/033; F17C 2223/0123; F17C 2205/0335; F17C 2225/036; F17C 2270/0139; F17C 13/06; F17C 13/02; F17C 1/005; F17C 5/002; B65D 11/08; F04F 99/00
USPC .... 417/85, 92, 101–103; 220/601, 582, 581; 206/0.6
See application file for complete search history.

(56) References Cited

U.S. PATENT DOCUMENTS

| | | | | |
|---|---|---|---|---|
| 1,929,350 | A | 10/1933 | Christensen | |
| 2,549,620 | A | 4/1951 | Orville | |
| 3,891,352 | A | 6/1975 | Tsukamoto | |
| 4,566,860 | A | 1/1986 | Cowan | |
| 4,809,771 | A | 3/1989 | Kennel et al. | |
| 5,421,162 | A | 6/1995 | Gustafson et al. | |
| 5,454,408 | A | 10/1995 | DiBella et al. | |
| 6,363,719 | B2 * | 4/2002 | Mohr | B60T 8/368 138/31 |
| 6,622,758 | B2 | 9/2003 | Drube et al. | |
| 6,652,243 | B2 | 11/2003 | Krasnov | |
| 8,037,677 | B2 | 10/2011 | Fong et al. | |
| 8,191,362 | B2 | 6/2012 | McBride et al. | |
| 9,109,614 | B1 | 8/2015 | Fong et al. | |
| 2002/0129867 | A1 | 9/2002 | Krasnov | |
| 2003/0039554 | A1 * | 2/2003 | Krasnov | F04F 1/06 417/103 |
| 2011/0203267 | A1 | 8/2011 | Ramming et al. | |
| 2011/0258999 | A1 | 10/2011 | Ingersoll et al. | |
| 2013/0213213 | A1 | 8/2013 | Cyphelly | |
| 2013/0240068 | A1 | 9/2013 | Samara-Rubio et al. | |

FOREIGN PATENT DOCUMENTS

| | | | |
|---|---|---|---|
| DE | 10 2012 003 288 | B3 | 3/2013 |
| EP | 2 273 119 | A1 | 3/2013 |
| WO | 2009/034421 | A1 | 3/2009 |
| WO | 2011/104556 | A2 | 9/2011 |
| WO | 2014/169108 | A2 | 10/2014 |
| WO | 2014/169113 | A2 | 10/2014 |
| WO | 2015006761 | A1 | 1/2015 |

OTHER PUBLICATIONS

Van de Ven, J. et al., "Liquid piston gas compression", *Applied Energy*, pp. 1-9, 2009.

* cited by examiner

HYDRAULIC SYSTEM FOR PRESSURIZATION OF GAS WITH REDUCTION OF DEAD VOLUME

CROSS-REFERENCE TO RELATED APPLICATION(S)

This application is a National Stage of PCT/US2014/046495, filed on 14 Jul. 2014, which claims benefit of U.S. Patent Application Ser. No. 61/845,726 filed on 12 Jul. 2013 and which applications are incorporated herein by reference. To the extent appropriate, a claim of priority is made to each of the above disclosed applications.

INTRODUCTION

The need for highly pressurized gasses is growing. This is particularly true with the advent of natural gas vehicles, which depend on highly compressed gases instead of fossil fuels for operation. In compressing such gases, high pressure chambers/vessels are sometimes utilized which pressurize gasses via the introduction of hydraulic fluid, During compression, it is important to move as much high pressure gas out of the compression chamber as possible to maximize the full potential of the system.

SUMMARY

In one embodiment, a system for compressing gas is described. The system includes a source of gas; a gas output location; first and second pressure vessels; first and second gas input lines for directing gas from the source of gas respectively to the first and second pressure vessels; first and second gas output lines for directing gas respectively from the first and second pressure vessels to the gas output location; a hydraulic system for moving hydraulic fluid back and forth between the first and second pressure vessels to compress gas in the first and second pressure vessels in an alternating manner, wherein gas is pressurized in the first pressure vessel by directing a first charge of gas from the source of gas into the first pressure vessel through the first gas input line and moving hydraulic fluid from the second pressure tank to the first pressure tank to compress the first charge of gas within the first pressure vessel, wherein gas is pressurized in the second pressure vessel by directing a second charge of gas from the source of gas into the second pressure vessel through the second gas input line and moving hydraulic fluid from both of the first pressure tank and the fluid overflow tank to the second pressure tank to compress the second charge of gas within the second pressure vessel. The system also includes an overflow arrangement for allowing all gas to be expelled from the first and second pressure vessels during pressurization of the gas, wherein at least one hydraulic fluid flows into the overflow arrangement when all of the first charge of gas has been forced from the first pressure vessel; and wherein at least some hydraulic fluid flows into the overflow arrangement when all of the second charge of gas has been forced from the second pressure vessel.

In another embodiment, a method for compressing gas is described. The method includes directing a charge of gas to a pressure vessel; moving hydraulic fluid into the pressure vessel to compress the charge of gas; forcing all of the compressed gas out of the pressure vessel to a charge tank; and allowing a portion of the hydraulic fluid to flow into an overflow tank.

Another embodiment describes a second method for compressing gas. The method includes directing a first charge of natural gas to a first pressure vessel; directing hydraulic fluid from a second pressure vessel to the first pressure vessel to compress the first charge of natural gas; forcing all of the compressed gas out of the first pressure vessel; allowing a portion of the hydraulic fluid in the first pressure vessel to leave the first pressure vessel and flow into an overflow tank; directing a second charge of natural gas to the second pressure vessel; and when the fluid in the overflow tank reaches a predetermined level, allowing the fluid in the overflow tank to flow into the second pressure vessel.

In yet another embodiment, a second system is described. The system includes a gas source; a gas output; a pressure vessel coupled to the gas source and the gas output; a hydraulic system that forces hydraulic fluid into the pressure vessel from the gas source to compress gas; and an overflow tank that receives overflow of hydraulic fluid once all gas has been expelled from the pressure vessel via the gas output.

These and various other features as well as advantages which characterize the systems and methods described herein will be apparent from arcading of the following detailed description and a review of the associated drawings. Additional features are set forth in the description which follows, and in part will be apparent from the description, or may be learned by practice of the technology. It is to be understood that both the foregoing general description and the following detailed description are exemplary and explanatory and are not intended to limit the scope of the various aspects disclosed herein.

DETAILED DESCRIPTION

In general, the embodiments herein describe methods and systems for gas compression. In some embodiments, the gas compression system described herein can be used in connection with a natural gas vehicle, in which a compressed natural gas ("CNG") is used as an alternative to fossil fuels. For example, the gas compression system includes a hydraulic system that can be selectively coupled (e.g., by a hose coupling) to a CNG tank used to power a natural gas vehicle. Due to needs for high-pressure (sometimes greater than 1500 psi or in the range of 1500-5000 psi) gas in this and other situations, the gas compression system described herein utilizes one or more compression chambers/vessels and a fluid overflow tank. The one or more chambers are filled with low pressure gas which is pressurized by the introduction of hydraulic fluid. To maximize the amount of high pressure output, the hydraulic fluid is pushed out of the compression chamber into the fluid overflow tank. This forces most if not all of the high pressure gas in the chamber to output from the chamber. The fluid overflow tank is connected to the system and the contents can be recirculated into the system.

Figure 1:
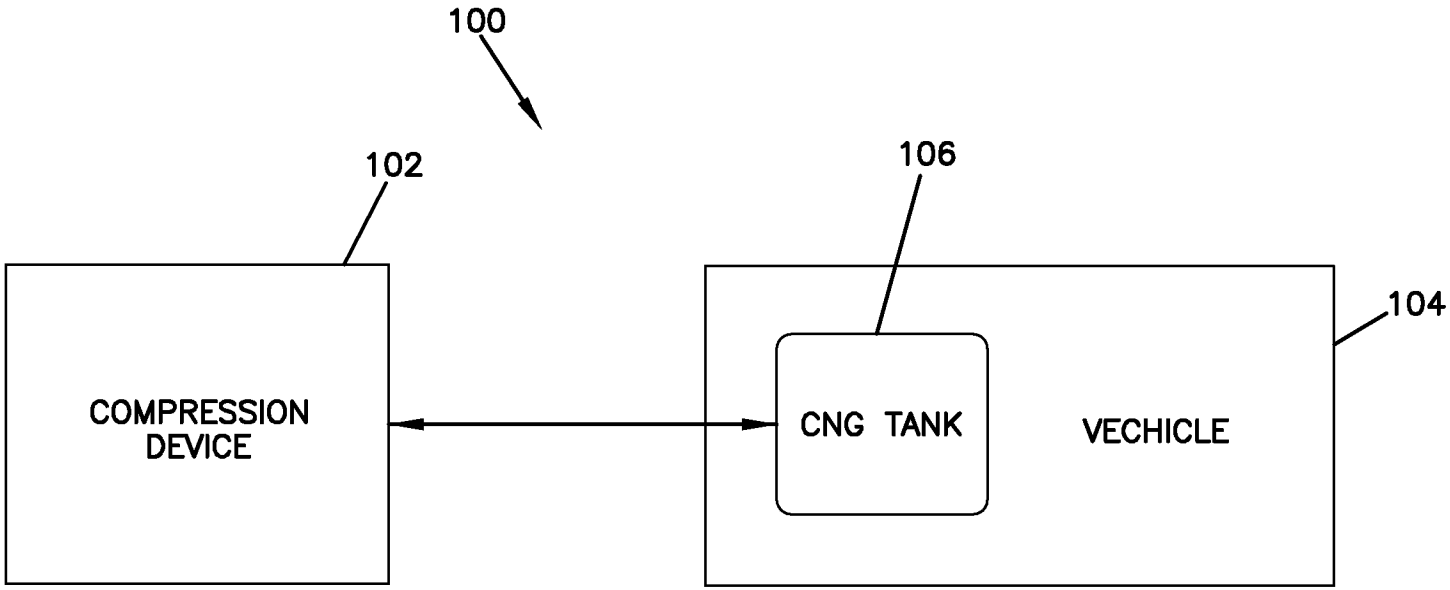
FIG. 1 is an illustration of an embodiment of a gas compression system.

Referring now to FIG. 1, an example embodiment of a gas compression system 100 is shown. The system 100 includes a compression device 102 and a natural gas vehicle 104. The vehicle 104 includes a CNG tank 106. In general, FIG. 1 illustrates one embodiment of the system 100 in which the compression device 102 is selectively connected to the CNG tank 106 for the purpose of compressing natural gas and delivering the compressed natural gas to the vehicle 104. In one example, the compression device 102 can be provided at a tank filling location (e.g., a vehicle owner's garage, a natural gas filling station, etc.). To reduce the space occupied by the compression device as well as the cost of the compression device, it is desirable for the overall size of the compression device to be minimized. In use, the vehicle may park at the filling location at which time the compression device 102 is connected to the CNG tank 106 and used to fill the GNU tank 106 with compressed natural gas. In certain examples, the filling/compression process can take place over an extended time (e.g., over one or more hours or overnight). After the CNG tank 106 has been filled with compressed natural gas having a predetermined pressure level, the compression device 102 is disconnected from the CNG tank 106 and the vehicle is ready for use. In some embodiments, the system is capable of outputting a maximum gas pressure less than or equal to 4500 psi. In yet further embodiments, the system is capable of outputting a maximum gas pressure less than or equal to 4000 psi.

The vehicle 104 is a natural gas vehicle that includes the CNG tank 106. The vehicle 104 is powered by a compressed natural gas. In some embodiments, as shown, the CNG tank 106 is located within the vehicle 104 or otherwise carried by the vehicle 104. It is understood that in some examples, the vehicle 104 may include more than one CNG tank 106, which are each configured to be coupled to the compression device 102. In other embodiments, the compression device 102 can fill an intermediate CNG tank that is then used to fill CNG tank 106 carried by the vehicle 104.

The compression device 102 is arranged and configured to compress a volume of gas to relatively high pressures, for example, pressures greater than 2000 psi. In certain examples, compression rates can be greater than 200/1. The compression device 102 utilizes a supply of natural gas and compresses the gas to a desired pressure. The compressed gas is delivered to the CNG tank 106 within the vehicle 104. In some embodiments, the supply of natural gas is provided as part of the compression device 102; however, in other embodiments, the supply of natural gas is external to the compression device 102. In certain examples, the supply of natural gas can be provided by a natural gas supply tank or a natural eras line that provides natural gas from a utility.

Figure 2:
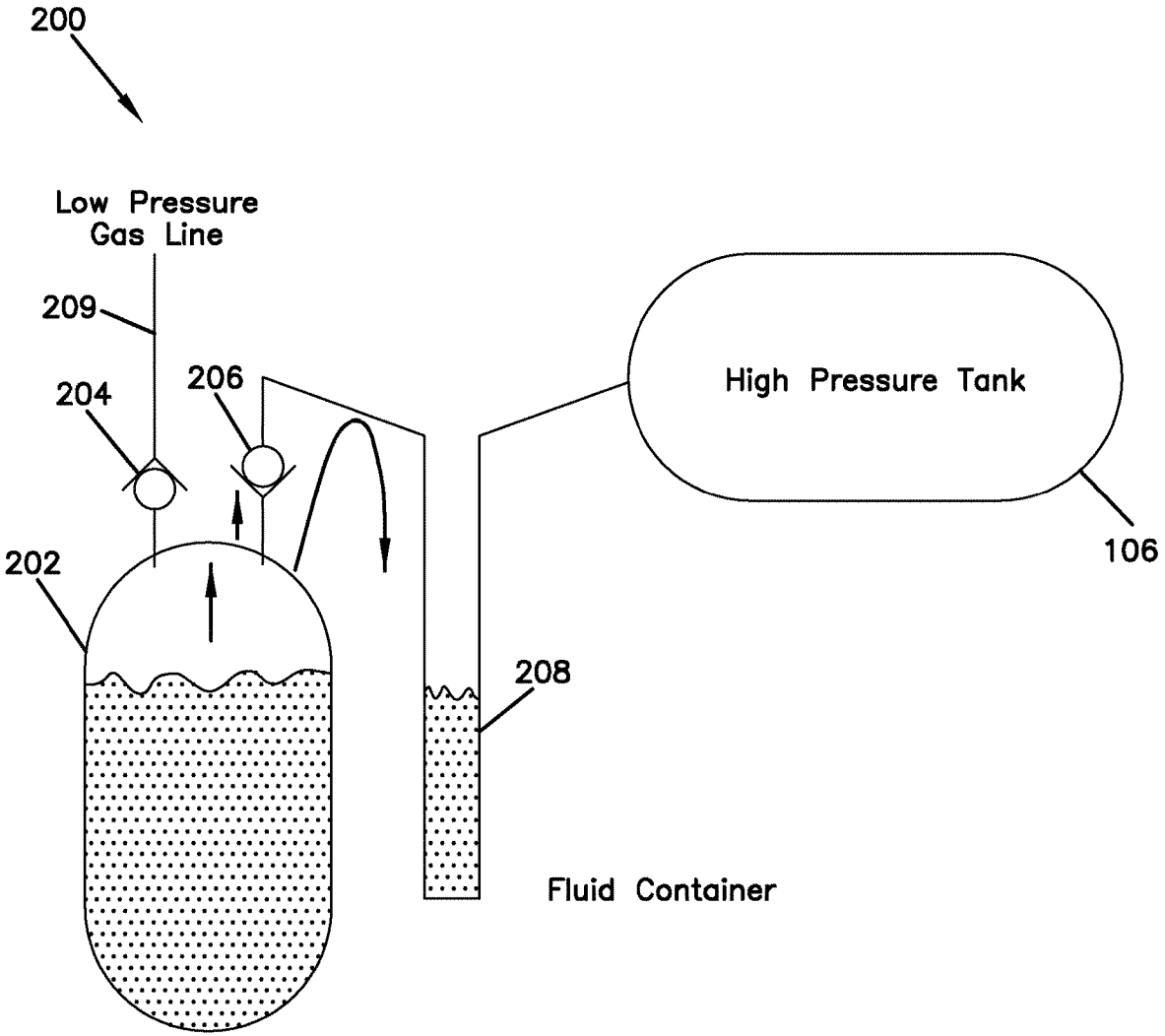
FIG. 2 is a schematic diagram of an embodiment of a gas compression system.

As will be described in greater detail below, the compression device 102 utilizes one or more pressure vessels for pressurizing the natural gas. The pressure vessels can be any size, but in some embodiments, the pressure vessels have a volume of less than 10 liters. During operation of the system 100, hydraulic fluid fills the one or more pressure vessels to pressurize the natural gas within the vessels. To maximize the amount of pressurized gas which is outputted by the compression device 102, a fluid overflow tank (as shown in FIG. 2) is provided. The fluid overflow tank allows the compression device 102 to completely fill the one or more pressure vessels with hydraulic fluid, thereby maximizing the use of the one or more pressure vessels. Thus, a dead volume (e.g., a volume of space in the one or more pressure vessels which is not filled with hydraulic fluid, and thus, not utilized for gas compression) is minimized, thereby maximizing the output of compressed gas.

Referring now to FIG. 2, a schematic diagram illustrating a portion of a gas compression system 200 is shown. The gas compression system 200 includes a pressure vessel 202, a first valve 204 (e.g., a one-way valve that allows flow into the vessel 202), a second valve 206 (e.g., a one-way valve that allows flow to exit the vessel 202), a fluid overflow tank 208, and the high pressure tank 106. The gas compression system 200 is configured to interface with a low pressure gas line 204 and the high pressure tank 106, which may be a CNG tank. For example, the gas compression system can receive low pressure gas from a low pressure gas source, and can deliver pressurized gas to the high pressure tank 106. It is understood that the compression system 200 is used for explanation, and does not show all aspects and components of the system.

In general, the pressure vessel 202 is hydraulically connected by a hydraulic line (not shown) which provides hydraulic fluid to the system 200. The system 200 generates a hydraulic piston effect within the pressure vessel 202 for compressing the low pressure gas within the pressure vessel 202. For example, a first charge of low pressure gas enters the pressure vessel 202 via the low pressure gas line 204. Next, hydraulic fluid enters the pressure vessel 202, pressurizing the low pressure gas as it enters the vessel 202. To maximize the volume of the vessel 202, the hydraulic fluid continues to fill the vessel 202 until it begins to overflow into the fluid overflow tank 208. In other words, as the hydraulic fluid overflows into the fluid overflow tank 208, all of the compressed gas within the vessel 202 is passed across the valve 206, thereby achieving 100% volumetric efficiency and no dead volume. The fluid in the fluid overflow tank 208 is then recirculated within the system 200 to pressurize a second charge of low pressure gas. The size of the tank 208 can be varied depending upon the frequency inn which it is desired to empty the tank 208 via recirculation.

Now referring to FIGS. 3A-3D, illustrations of an embodiment of a gas compression system having a fluid trap are shown. The fluid trap may be referred to herein as an overflow fluid tank, a tank, a fluid container, a trap, or the like. The gas compression system 300 is shown transferring hydraulic fluid between first and second pressure vessels 302, 310 to pressurize charges of low pressure gas from low pressure gas lines 324, 326. A fluid overflow tank 307 is shown as one example of the fluid overflow tank 208 in FIG. 2. In the example, the fluid overflow tank 307 includes two branches, a first branch 307*a* and a second branch 307*b*. Though one fluid overflow tank 307, the first branch 307*a* houses overflow from the first pressure vessel 302, and the second branch 307*b* houses overflow from the second pressure vessel 310. In other embodiments, the fluid over tank 208 may include only one tank with no branches or two or more independent tanks.

As described above, the gas compression system 300 is configured to interface a natural gas supply 329 and a high pressure tank, such as the CNG tank 328. For example, the gas compression system 300 can receive natural gas from the low pressure gas lines 324, 326, and can deliver pressurized natural gas to the CNG tank 328. The low pressure gas input lines 324, 326 (i.e., vessel charge lines) direct low pressure gas from a natural gas supply respectively to the first and second pressure vessels 302, 310. First and second natural gas output lines 308, 309 direct compressed natural gas respectively from the first and second pressure vessels 302, 310 to the CNG tank 328. The first and second natural gas output lines 308, 309 can merge together and terminate at a fluid coupling (e.g., a hose coupling) used to selectively connect and disconnect the output lines 308, 309 to and from the CNG tank 328 as needed.

A first set of valves 304, 306 can include one-way check valves 304, 306 and the second set of valves 312, 314 can include one-way check valves 312, 314. The one way check-valves 304, 314 allow low pressure gas from the input lines 324, 326 to enter the pressure vessels 302, 310 while preventing the compressed natural gas from within the pressure vessels 302, 310 from back-flowing from pressure vessels 302, 310 through the input lines 324, 326 during gas compression. The one way check-valves 306, 312 allow compressed gas to exit the pressure vessels 302, 310 through the output lines 308, 309 during gas compression while preventing compressed gas from the CNG tank 328 from back-flowing into the pressure vessels 302, 310 through the output lines 306, 312.

The first and second pressure vessels 302, 310 are hydraulically connected by a hydraulic line 330. The motor M and pump P input energy into the system for moving the hydraulic fluid through the hydraulic line 330 between the pressure vessels 302, 310 and for generating a hydraulic piston effect within the pressure vessels 302, 310 for compressing the low pressure gas within the pressure vessels 302, 310. In some embodiments, the pump P may be bi-directional or alternatively the pump P can pump in one direction, and a hydraulic valve (e.g., a spool valve) may be positioned along the hydraulic line 330 to control/alternate the direction in which the hydraulic fluid is pumped by the pump P through the hydraulic line 330 between the pressure vessels 302, 310.

In general, the gas compression system 300 receives low pressure gas from a low pressure gas supply and alternatingly directs the gas through each of the first and second pressure vessels 302, 310 to pressurize the low pressure gas. The pressurized gas is delivered to the CNG tank 328. As stated above, in some embodiments, the CNG tank 328 can be located within a natural gas vehicle, such as the vehicle 104.

FIGS. 3A-3D show the gas compression system 300 in four operating states of a compression operating cycle. In the first operating state of FIG. 3A, a first charge of gas is pressurized at the first pressure vessel 302 by art in-flow of hydraulic fluid from the second pressure vessel 310. As the hydraulic fluid is emptied from the second pressure vessel 310, a second charge of gas enters the second pressure vessel 310 to be later pressurized.

Figure 3A:
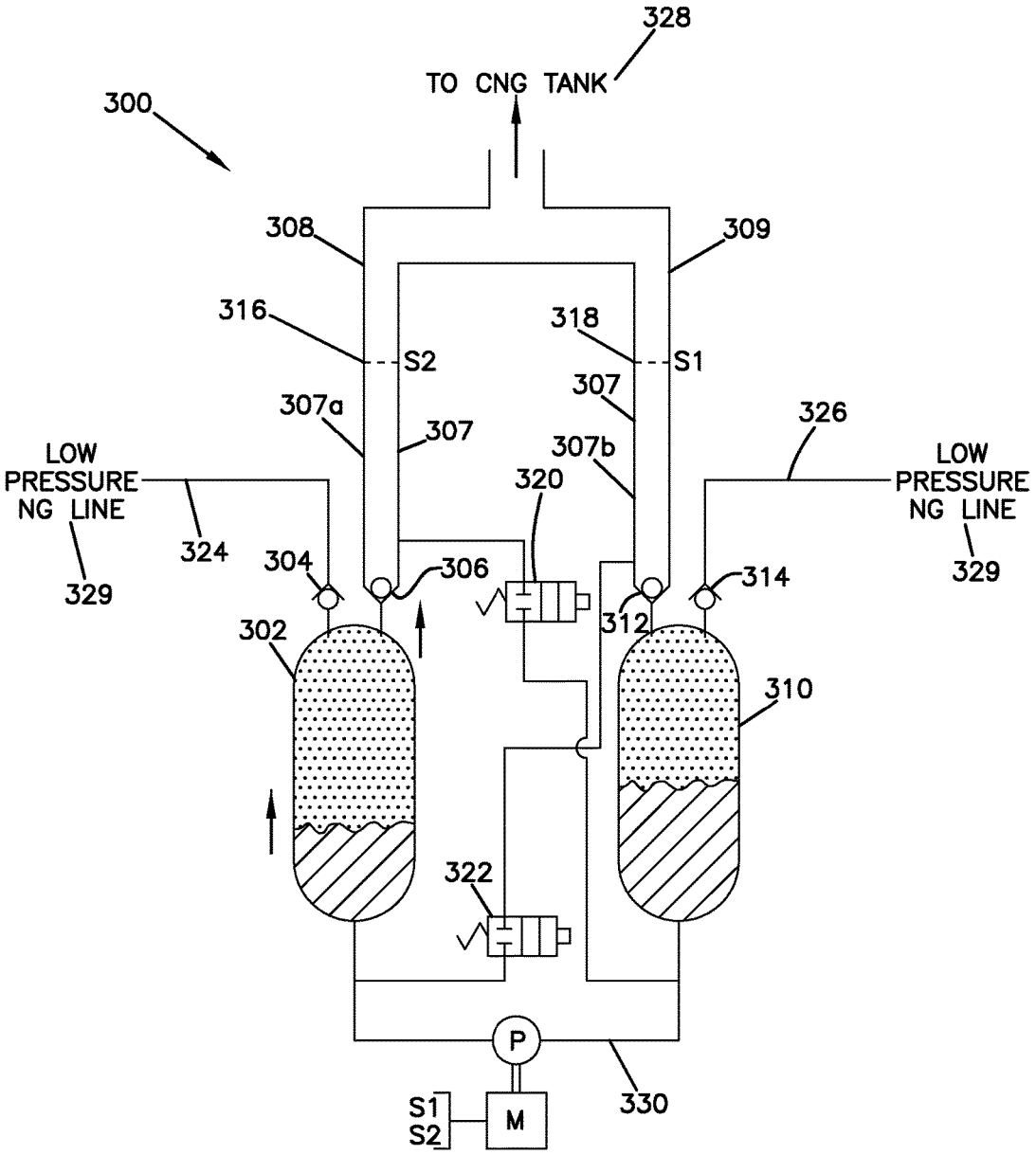
FIG. 3A is an illustration of an embodiment of a gas compression system having a fluid trap. The gas compression system is shown transferring hydraulic fluid into a first pressure vessel from a second pressure vessel to pressurize a first charge of gas in the first pressure vessel.
Figure 3B:
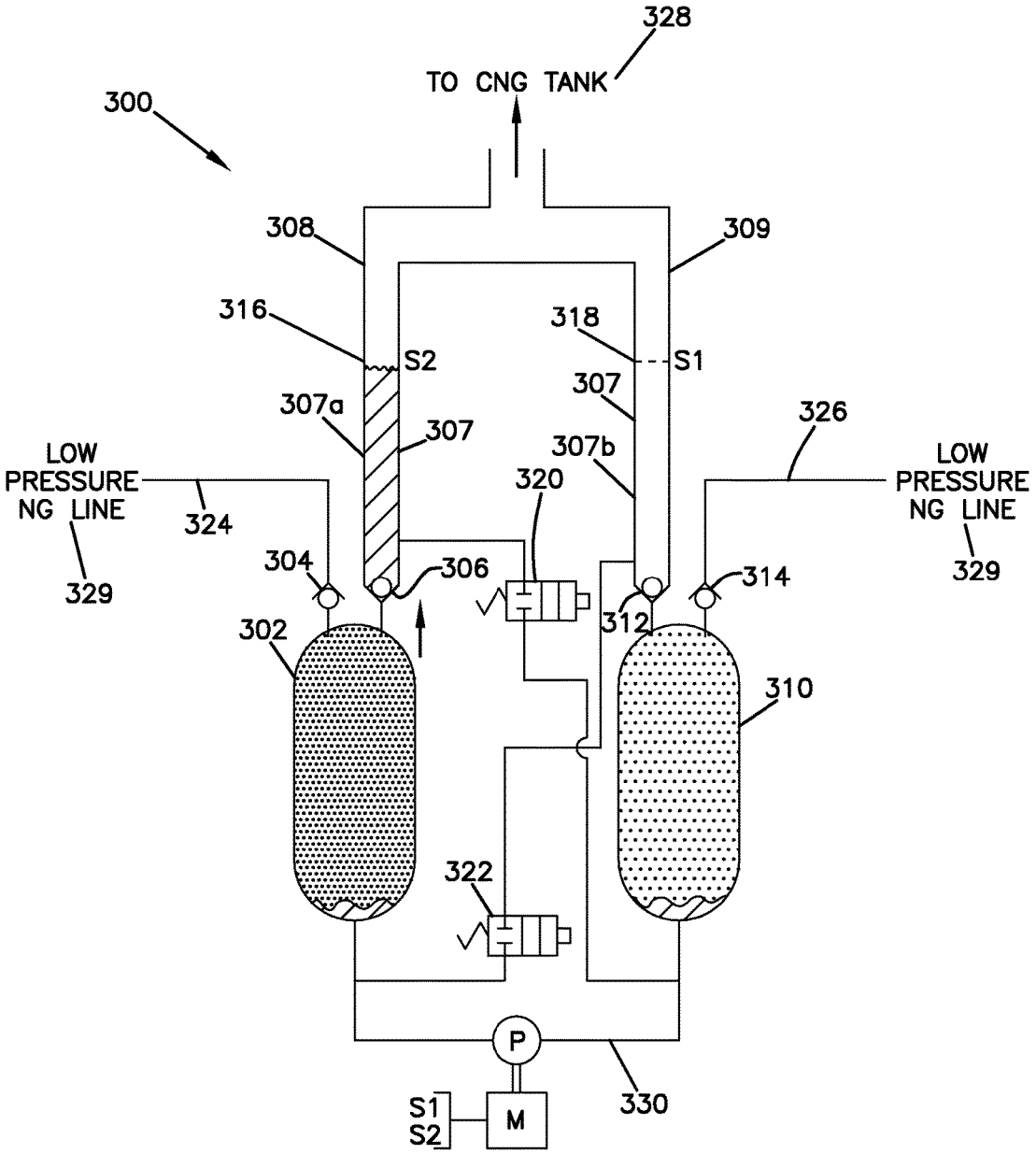
FIG. 3B is an illustration of an embodiment of a gas compression system having a fluid trap. The gas compression system is shown transferring hydraulic fluid from a first pressure vessel to the fluid trap to a second pressure vessel to cause a charge of gas to be compressed within the second pressure vessel.

In the second operating state of FIG. 3B, the first pressure vessel 302 is fully filled with hydraulic fluid and the second pressure vessel 310 does not contain hydraulic fluid or is substantially void of hydraulic fluid. As the vessel 302 is filled with hydraulic fluid, the first charge of gas from line 324 is pressurized and forced out of the vessel through line 308. The pressurized hydraulic fluid is pumped into the vessel 302 by pump P through line 330. The hydraulic fluid can be selected from any number of fluids which have relatively low vapor pressures. Other qualities that are favorable in the hydraulic fluid include, for example, low absorptivity and solubility of component gases, chemically inert, highly viscous (e.g., a viscosity index greater than 100), and/or having a pour point of less than 40 degrees Celsius. Some examples of suitable fluids include: glycols, highly refined petroleum based oils, synthetic hydrocarbons, silicone fluids, and ionic fluids. It is understood that this list is merely exemplary, and other fluids may be utilized.

To maximize use of the first pressure vessel 302, the first pressure vessel 302 is completely filled with hydraulic fluid to pressurize all gas in the first pressure vessel 302. All of the compressed gas then flows into the CNG tank 328 via the output line 308, in the process of this flow, some hydraulic fluid flows through the check valve 306 into the fluid overflow tank 307. The valves 320, 322 are closed as hydraulic fluid is pumped into the first vessel 302.

Once the tank 302 has been filled with hydraulic fluid, the second charge of low pressure gas (e.g., natural gas) may be directed from a natural gas supply, through the second input line 326 and the check valve 314 into the second pressure vessel 310. Alternatively, as stated above, the second charge of gas may already be present in the second pressure vessel 310 as it entered in the first stage. In both embodiments, the second pressure vessel 310 is filled with the second charge of low pressure gas ready to be pressurized by hydraulic fluid.

When the fluid level in the fluid overflow tank 307 reaches a preset fluid level (e.g., level 316) as shown at FIG. 3A, a fluid switch S2 will send an analog or digital signal to the system control of the system 300. The controller will send an "on" pulse signal to the first valve 320. In response, the valve 320 opens for a short duration based on the pulse width of the signal. The pressure from the CNG tank 328 will push the fluid in the fluid overflow tank 307 through the valve 320 to the bottom of the second pressure vessel 310. As the fluid flows to the second pressure vessel 310, the fluid level in the fluid overflow tank 307 reduces.

The system 300 may be configured such that the "on" pulse signal sent to the first valve 320 is either open loop or closed loop. If the signal is open loop, the valve 320 closes based on a predetermined value prior to operation of the system 300. If the signal is closed loop, the valve 320 closes when the switch S2 detects that the fluid level on the fluid overflow tank 307 has dropped to a predetermined level. Upon reaching the predetermined level, the switch S2 then sends a signal to valve 320 to switch off the pulse and closes the valve 320.

Figure 3C:
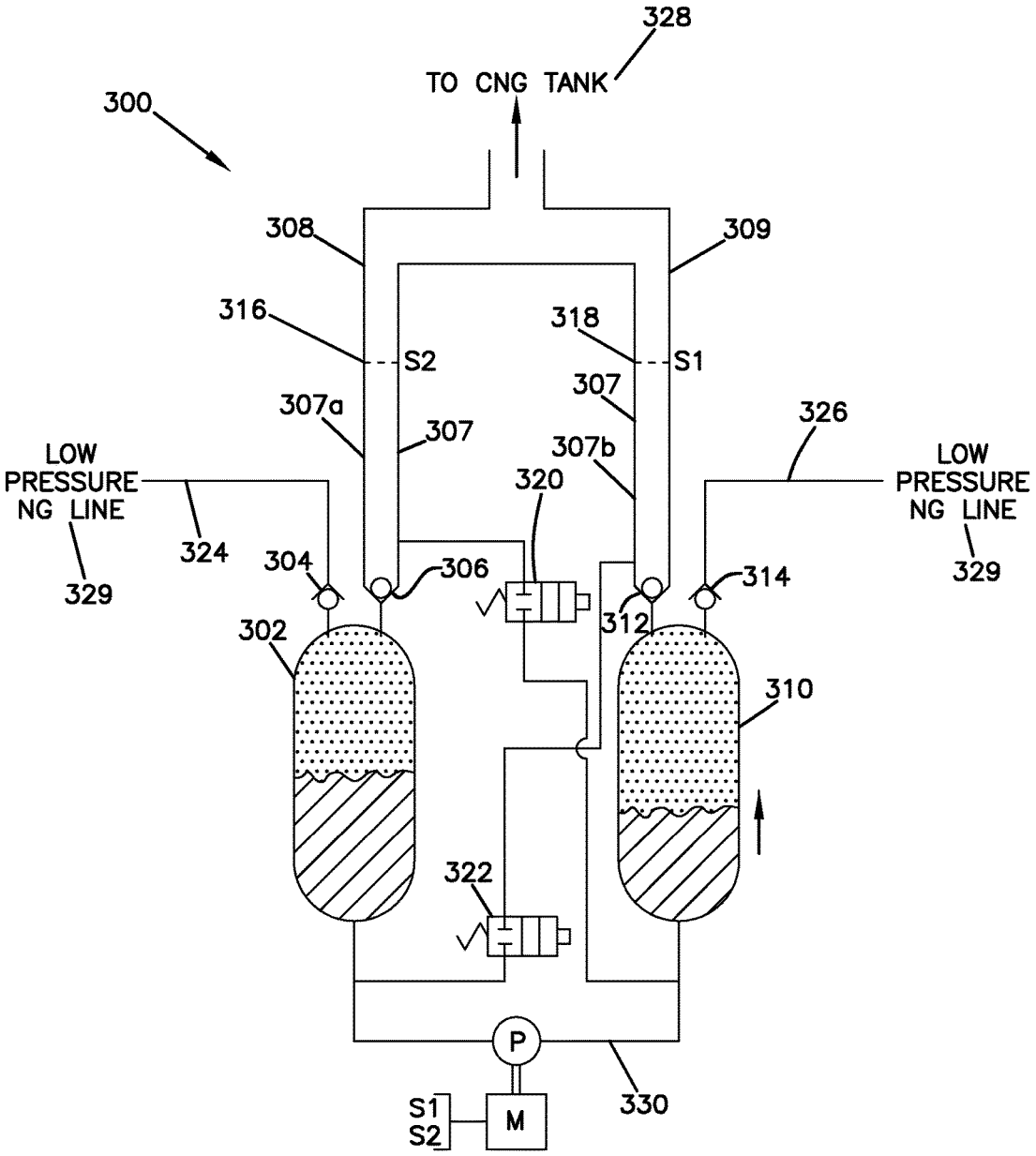
FIG. 3C is an illustration of an embodiment of a gas compression system having a fluid trap. The gas compression system is shown transferring hydraulic fluid into a second pressure vessel from a first pressure vessel to pressurize a second charge of gas in the second pressure vessel.

The first valve 320 is closed after the fluid from the fluid overflow tank 307 is emptied to the second pressure vessel 310. Additional hydraulic fluid fills the second pressure vessel 310 from the hydraulic line 330, which consists of the hydraulic fluid that is pumped by the pump P from the first pressure vessel 302 through line 330 to the second pressure vessel 310. As the second pressure vessel 310 fills with hydraulic fluid, the hydraulic fluid functions as a hydraulic piston causing the second charge of natural gas within the second pressure vessel 310 to be compressed. The valves 320, 322 are closed as the second pressure vessel 310 fills. This third operating state is shown at FIG. 3C.

Figure 3D:
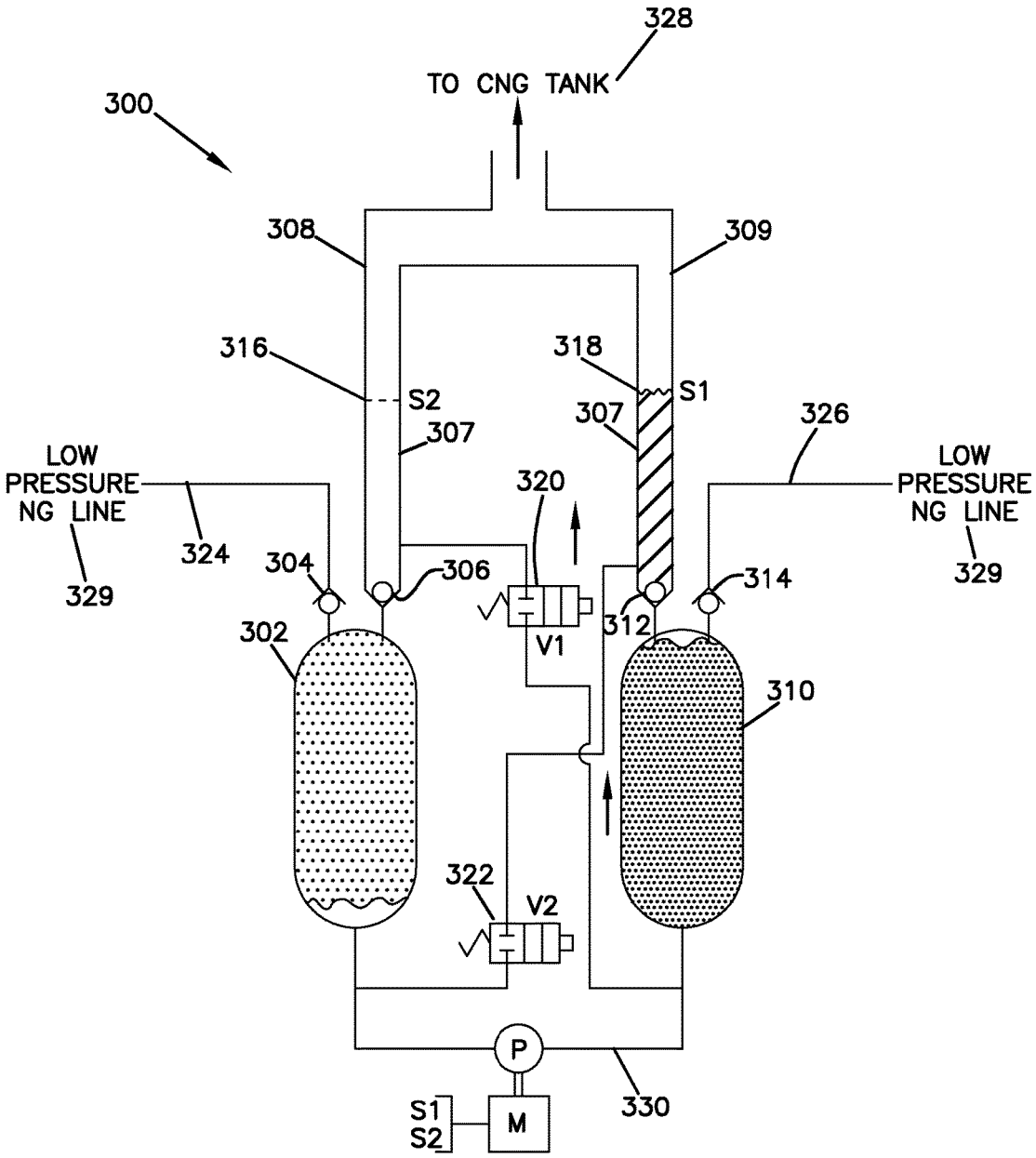
FIG. 3D is an illustration of an embodiment of a gas compression system having a fluid trap. The gas compression system is shown transferring hydraulic fluid from a second pressure vessel to the fluid trap to a first pressure vessel to cause a charge of gas to be compressed within the first pressure vessel.

Once the pressure within the second pressure vessel 310 exceeds the pressure in the CNG tank 218, compressed natural gas from the second pressure vessel 310 begins to exit the second pressure vessel 310 through the check valve 312 and flows through the output line 309 to fill/pressurize the CNG tank 328. This continues until the second pressure vessel 310 is full of hydraulic fluid and all of the charge of natural gas has been forced from the second pressure vessel 310 into the CNG tank 328. At this point, the first pressure vessel 302 is void or substantially void of hydraulic fluid. This fourth operating state is shown at FIG. 3D.

To maximize use of the second pressure vessel 310, the second pressure vessel 310 is completely filled with hydraulic fluid to pressurize all gas in the second pressure vessel 310. When all of the compressed gas flows to the CNG tank 328, some fluid flows through the check valve 312 into the fluid overflow tank 307.

Once the second pressure vessel 310 has been filled with hydraulic fluid and the first pressure vessel 302 is empty, a third charge of low pressure gas (e.g., natural gas) may be directed from a natural gas supply, through the first input line 324 and the check valve 304 into the first pressure vessel 302 to continue the cycle of compression.

When the fluid level in the fluid overflow tank 307 reaches a preset fluid level (e.g., level 318), the fluid switch S1 will send an analog or digital signal to the system control of the system 300. The controller will send an "on" pulse signal to a second valve 322 to open the valve 322 as shown at FIG. 3D. Similarly, as stated above, the system 300 may be configured such that the "on" pulse signal sent to the second valve 322 is either open loop or closed loop. In response to the pulse signal, the valve 322 opens for a short duration based on the pulse width of the signal. The pressure from the CNG tank 328 will push the fluid in the fluid overflow tank 307 through the valve 322 to the bottom of the first pressure vessel 302. As the fluid flows to the first pressure vessel 302, the fluid level in the fluid overflow tank 307 reduces.

During a normal charging sequence/operation, it will be appreciated that the gas compression system 300 will be repeatedly cycled between the first and second operating states until the pressure within the CNG tank 328 is fully pressurized (i.e., until the pressure within the CNG tank 328 reaches a desired or predetermined pressure level). Though not shown, it is understood that one or more pressure sensors may be positioned at the CNG tank 328, along the output lines 308, 309 and/or at the pressure vessels 302, 310 for monitoring system pressures. It will be appreciated that a controller (e.g., an electronic controller), as discussed above, can be provided for controlling operation of the system. The controller can interface with the various components of the system (e.g., pressure sensors, valves, pump, motor, etc.). In some embodiments, the pump P can be bi-directional.

It will be appreciated that as the natural gas is compressed, the temperature increases. Such increases in temperature can negatively affect efficiency. For example, if the pressurized natural gas provided to the CNG tank 328 has a temperature higher than ambient air, the pressure in the CNG tank 328 will drop as the natural gas in the CNG tank 328 cools. Thus, during charging, the CNG tank 328 will need to be charged to a significantly higher pressure to compensate for the anticipated pressure drop which takes place when the natural gas in the CNG tank 328 cools. To enhance the thermal transfer properties of the pressure vessels 302, 310, the pressure vessels 302, 310 can each include a media that contain/contact the natural gas during compression. The media provide an increased thermal mass for absorbing heat and an increased surface area for allowing the heat to be quickly transferred from the natural gas to the thermal mass. Additionally or alternatively, the system 300 may include a cooler within the hydraulic circuit.

With respect to FIGS. 3A-3D, it is understood that various embodiments of the overflow tank 307 may exist. For example, the overflow tank 307 may include multiple (e.g., two or more) separate tanks. Alternatively, the overflow tank 307 may be one large tank that does not need to be emptied during each cycle. Instead, the overflow tank 307 may be periodically emptied into either the first or second pressure vessels 302, 310. In yet further embodiments, the overflow tank 307 may be one tank having one or more branches. In some embodiments, the overflow tank 307 arrangement may empty hydraulic fluid into the opposite pressure vessel after each compression phase.

Figure 4:
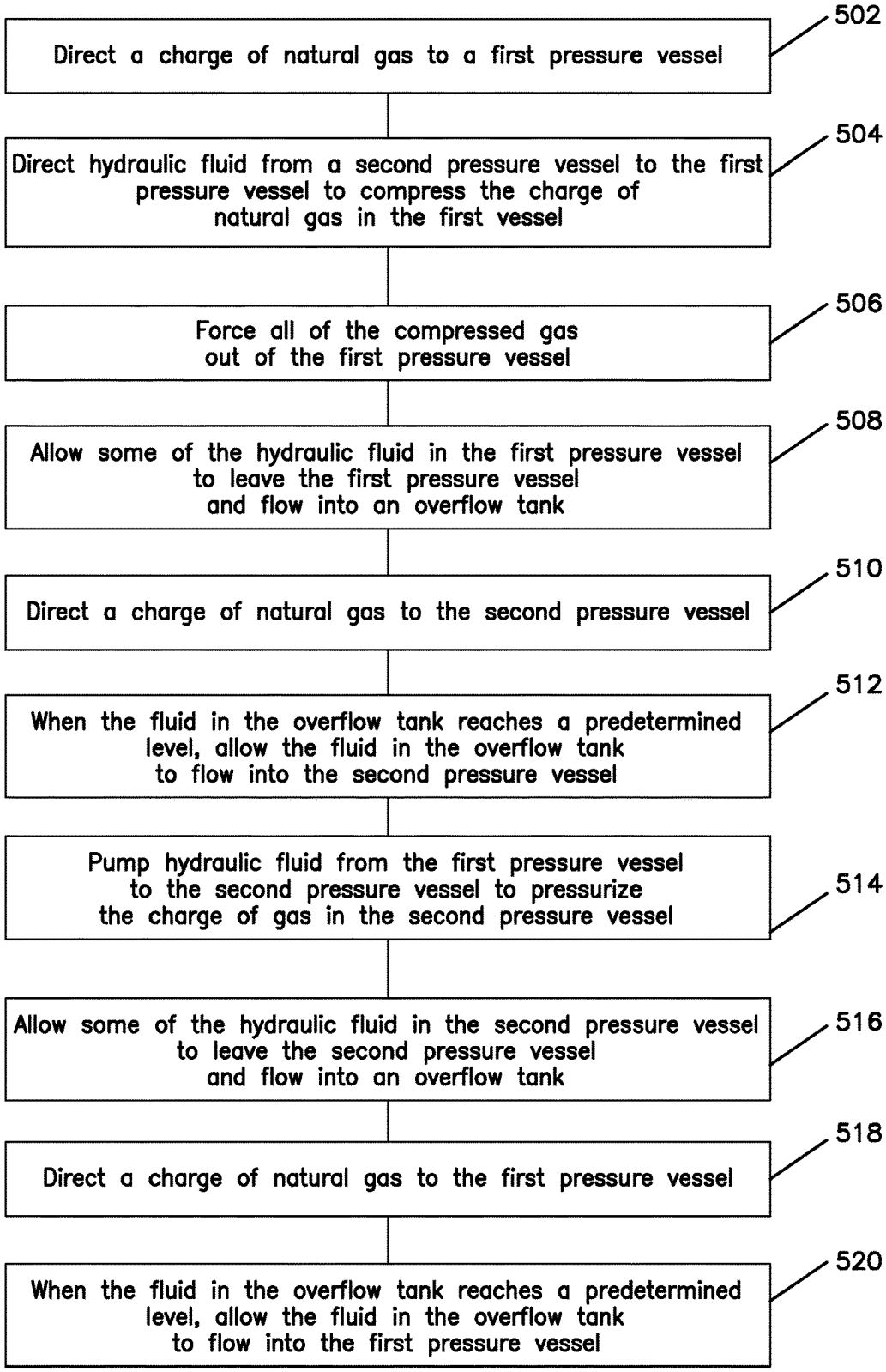
FIG. 4 is a flow diagram representing an embodiment of a method for compressing gas.

Referring now to FIG. 4, an example flow chart depicting a method 500 for gas compression is shown. In general, the method 500 is one example of a method for compressing gas. Although the method 500 will be described utilizing components illustrated in FIGS. 1-3D, it is understood that such description is non-limiting. The method 500 begins at operation 502 where a first charge of natural gas is directed through a first natural gas input line a first pressure vessel. For example, utilizing the system 400, a first charge of natural gas may be directed from a natural gas supply to the first pressure vessel 402. The gas is directed into the first pressure vessel 402 to for the purpose of being pressurized within the first pressure vessel 402.

Next, the method 500 proceeds to operation 504 where the hydraulic fluid is forced from a second pressure vessel to the first pressure vessel. If this is not the first compression cycle, the hydraulic fluid may also be forced into the first pressure vessel via a fluid overflow tank, as will be discussed below. As the fluid enters the first pressure vessel, the natural gas within the first pressure vessel is pressurized in the vessel.

The method 500 next moves to operation 506, where all of the compressed gas in the first pressure vessel is forced out of the first pressure vessel. In some embodiments, the compressed gas is forced into a CNG tank. As stated above, in some example, the CNG tank may be positioned within a vehicle.

The method 500 proceeds to operation 508 where some of the hydraulic fluid within the first pressure vessel flows out of the first pressure vessel and into an overflow tank. As the hydraulic fluid overflows into the fluid overflow tank, all of the compressed gas within the first pressure vessel is passed across a valve (e.g., valve 406), thereby achieving 100% volumetric efficiency and no dead volume.

The method 500 next proceeds to operation 510 where a second charge of natural gas is directed to the second pressure vessel. This operation may occur after operation 510 or simultaneously with operation 510. The second charge of natural gas fills the second pressure vessel and awaits the introduction of hydraulic fluid, which pressurizes the second charge of gas.

Next, the method 500 proceeds to operation 512. When the fluid in the overflow tank reaches a predetermined level, the fluid (or a portion thereof) is allowed to flow from the overflow tank into the second pressure vessel via a valve, for example. In this way, the hydraulic fluid in the fluid overflow tank is recirculated with the system and used to pressurize further charges of natural gas, such as the second charge of natural gas.

The method 500 then proceeds to operation 514 where hydraulic fluid is pumped from the first pressure vessel to the second pressure vessel to pressurize the charge of gas in the second pressure vessel 514. This step ensures that the pressure within the second pressure vessel 514 exceeds the pressure in the CNG tank.

The method 500 then proceeds to operations 516, 518, and 520 (in order), in which the cycle continues similarly as described above, but with respect to the second pressure vessel.

The method 500 then proceeds back to operation 502 and the cycle continues until a desired amount of pressurized gas fills the CNG tank. It is understood that the above-described system is applicable in any situation where high compression rates are desired. Though the system is sometimes described herein as utilizing a natural gas, it is further understood that the system may pressurize any gas, including, for example, fuel gas, hydrogen, or the like.

What is claimed is:

1. A system for compressing gas, the system comprising:

a source of gas;

a gas output location;

first and second pressure vessels;

first and second gas input lines for directing gas from the source of gas respectively to the first and second pressure vessels;

first and second gas output lines for directing gas respectively from the first and second pressure vessels to the gas output location;

a hydraulic system for moving hydraulic fluid back and forth between the first and second pressure vessels to compress gas in the first and second pressure vessels in an alternating manner, wherein gas can be pressurized in the first pressure vessel by directing a first charge of gas from the source of gas into the first pressure vessel through the first gas input line and moving hydraulic fluid from the second pressure tank to the first pressure tank to compress the first charge of gas within the first pressure vessel, wherein gas can be pressurized in the second pressure vessel by directing a second charge of gas from the source of gas into the second pressure vessel through the second gas input line and moving hydraulic fluid from both of the first pressure tank and the fluid overflow tank to the second pressure tank to compress the second charge of gas within the second pressure vessel; and an overflow arrangement for allowing all gas to be expelled from the first and second pressure vessels, wherein at least some hydraulic fluid flows into the overflow arrangement when all of the first charge of gas has been forced from the first pressure vessel; and wherein at least some hydraulic fluid flows into the overflow arrangement when all of the second charge of gas has been forced from the second pressure vessel;

wherein the overflow arrangement includes an overflow tank that includes at least one sensor, wherein when the hydraulic fluid flows into the fluid overflow tank and reaches the at least one sensor, the hydraulic fluid in the fluid overflow tank is forced out of the fluid overflow tank and into at least one of the first and second pressure vessels.

2. The system of claim 1, wherein the overflow arrangement empties to the second pressure vessel after gas compression is complete at the first pressure vessel, and the overflow arrangement empties to the first pressure vessel after gas compression is complete at the second pressure vessel.

3. The system of claim 1, wherein the overflow arrangement includes an overflow tank having a first branch and a second branch.

4. The system of claim 3, wherein hydraulic fluid from the first pressure vessel flows into the first branch and hydraulic fluid from the second pressure vessel flows into the second branch.

5. The system of claim 1, wherein the system includes a control valve which is in communication with the at least one sensor.

6. The system of claim 1, wherein the system includes a spool valve which controls a direction of flow of the hydraulic fluid.

7. The system of claim 1, wherein the system is capable of outputting a maximum gas pressure less than or equal to 4500 psi.

8. The system of claim 1, wherein the system is capable of outputting a maximum gas pressure less than or equal to 4000 psi.

9. The system of claim 1, wherein the first and second pressure vessels each have a volume less than 10 liters.

10. The system of claim 1, wherein the hydraulic system includes a hydraulic flow line that fluidly connects the first and second pressure vessels together and a hydraulic pump for moving hydraulic fluid through the hydraulic flow line between the first and second pressure vessels.

11. The system of claim 1, wherein the overflow arrangement includes an overflow tank that has a fluid output line that is coupled to a bottom of the first pressure vessel.

12. The system of claim 1, wherein a cooler is positioned along the hydraulic flow line for cooling the hydraulic fluid.

13. A system for compressing gas, the system comprising:

a source of gas;

a gas output location;

first and second pressure vessels;

first and second gas input lines for directing gas from the source of gas respectively to the first and second pressure vessels;

first and second gas output lines for directing gas respectively from the first and second pressure vessels to the gas output location;

a hydraulic system for moving hydraulic fluid back and forth between the first and second pressure vessels to compress gas in the first and second pressure vessels in an alternating manner, wherein gas is pressurized in the first pressure vessel by directing a first charge of gas from the source of gas into the first pressure vessel through the first gas input line and moving hydraulic fluid from the second pressure tank to the first pressure tank to compress the first charge of gas within the first pressure vessel, wherein gas is pressurized in the second pressure vessel by directing a second charge of gas from the source of gas into the second pressure vessel through the second gas input line and moving hydraulic fluid from both of the first pressure tank and the fluid overflow tank to the second pressure tank to compress the second charge of gas within the second pressure vessel; and an overflow arrangement for allowing all gas to be expelled from the first and second pressure vessels during pressurization of the gas, wherein at least some hydraulic fluid flows into the overflow arrangement when all of the first charge of gas has been forced from the first pressure vessel; and wherein at least some hydraulic fluid flows into the overflow arrangement when all of the second charge of gas has been forced from the second pressure vessel;

wherein the overflow arrangement includes an overflow tank that includes a first sensor and a second sensor, wherein when the hydraulic fluid flows into the fluid overflow tank and reaches the first sensor, the hydraulic fluid in the fluid overflow tank is forced out of the fluid overflow tank and into at least one of the first and second pressure vessels, and wherein when the hydraulic fluid reaches the second sensor, the hydraulic fluid cannot flow out of the fluid overflow tank.

14. The system of claim 13, wherein the system includes a first control valve which is in communication with the first sensor and a second control valve which is in communication with the second sensor.

15. The system of claim 13, wherein the overflow arrangement empties to the second pressure vessel after gas compression is complete at the first pressure vessel, and the overflow arrangement empties to the first pressure vessel each time gas compression is complete at the second pressure vessel.

16. The system of claim 13, wherein the overflow arrangement includes an overflow tank having a first branch and a second branch.

17. The system of claim 16, wherein hydraulic fluid from the first pressure vessel flows into the first branch and hydraulic fluid from the second pressure vessel flows into the second branch.

18. The system of claim 13, wherein the overflow arrangement includes an overflow tank that has a fluid output line that is coupled to a bottom of the first pressure vessel.

19. A system for compressing gas, the system comprising:

a source of gas;

a gas output location;

first and second pressure vessels;

first and second gas input lines for directing gas from the source of gas respectively to the first and second pressure vessels;

first and second gas output lines for directing gas respectively from the first and second pressure vessels to the gas output location;

a hydraulic system for moving hydraulic fluid back and forth between the first and second pressure vessels to compress gas in the first and second pressure vessels in an alternating manner, wherein gas is pressurized in the first pressure vessel by directing a first charge of gas from the source of gas into the first pressure vessel through the first gas input line and moving hydraulic fluid from the second pressure tank to the first pressure tank to compress the first charge of gas within the first pressure vessel, wherein gas is pressurized in the second pressure vessel by directing a second charge of gas from the source of gas into the second pressure vessel through the second gas input line and moving hydraulic fluid from both of the first pressure tank and the fluid overflow tank to the second pressure tank to compress the second charge of gas within the second pressure vessel; and an overflow arrangement for allowing all gas to be expelled from the first and second pressure vessels during pressurization of the gas, wherein at least some hydraulic fluid flows into the overflow arrangement when all of the first charge of gas has been forced from the first pressure vessel; and wherein at least some hydraulic fluid flows into the overflow arrangement when all of the second charge of gas has been forced from the second pressure vessel;

a first check valve located between the overflow arrangement and the first pressure vessel, the first check valve blocking fluid flow from the overflow arrangement to the first pressure vessel;

a second check valve located between the overflow arrangement and the second pressure vessel, the second check valve blocking fluid flow from the overflow arrangement to the second pressure vessel;

a first fluid sensor located between the first check valve and the overflow arrangement; and a second fluid sensor located between the second check valve and the overflow arrangement.

20. The system of claim 19, further comprising:

a first control valve operably connected to the first fluid sensor, the first control valve providing selective fluid communication between the overflow arrangement and the second pressure vessel; and a second control valve operably connected to the second fluid sensor, the second control valve providing selective fluid communication between the overflow arrangement and the first pressure vessel.

* * * * *